US011390483B2

(12) United States Patent
Kurosaki

(10) Patent No.: US 11,390,483 B2
(45) Date of Patent: Jul. 19, 2022

(54) LOG ROLL MANUFACTURING APPARATUS

(71) Applicant: CORELEX SHIN-EI CO., LTD., Fuji (JP)

(72) Inventor: Satoshi Kurosaki, Fuji (JP)

(73) Assignee: CORELEX SHIN-EI CO., LTD., Fuji (JP)

( * ) Notice: Subject to any disclaimer, the term of this patent is extended or adjusted under 35 U.S.C. 154(b) by 364 days.

(21) Appl. No.: 16/611,277

(22) PCT Filed: Oct. 20, 2017

(86) PCT No.: PCT/JP2017/037977
§ 371 (c)(1),
(2) Date: Nov. 6, 2019

(87) PCT Pub. No.: WO2019/077732
PCT Pub. Date: Apr. 25, 2019

(65) Prior Publication Data

US 2020/0165096 A1 May 28, 2020

(51) Int. Cl.
*B65H 39/16* (2006.01)
*A47K 10/16* (2006.01)
(Continued)

(52) U.S. Cl.
CPC ..... *B65H 39/16* (2013.01); *A47K 10/16* (2013.01); *B65H 20/02* (2013.01); *D21H 27/30* (2013.01)

(58) Field of Classification Search
CPC ..... B65H 39/16; B65H 20/02; B65H 8/145; D21H 27/30; D21H 27/002
(Continued)

(56) References Cited

U.S. PATENT DOCUMENTS 3,823,887 A * 7/1974 Gerstein ..... B65H 39/16 242/521
3,853,279 A * 12/1974 Gerstein ..... B65H 19/2284 242/521
(Continued)

FOREIGN PATENT DOCUMENTS

CN 1861506 A 11/2006
CN 101842534 A 9/2010
(Continued)

OTHER PUBLICATIONS

International Search Report for PCT/JP2017/037977 dated Jan. 16, 2018 (PCT/ISA/210).
(Continued)

*Primary Examiner* — Patrick H Mackey
(74) *Attorney, Agent, or Firm* — Sughrue Mion, PLLC

(57) ABSTRACT

A log roll can be efficiently manufactured in a log roll manufacturing apparatus. When yet-to-be-wound base paper constituted of stacked sheets of first base paper and second base paper fed from first and second parent rolls is supplied to a main processing-winding unit, if a winder capable of manufacturing a two-ply log roll and including a sub processing-winding unit is to manufacture a one-ply log roll by using the main processing-winding unit, the yet-to-be-wound base paper constituted of the stacked sheets of the first base paper and the second base paper is separated into first separated yet-to-be-wound base paper and second separated yet-to-be-wound base paper by a base-paper separating unit. Then, one-ply log rolls are simultaneously manufactured by using the main processing-winding unit supplied with the first separated yet-to-be-wound base paper and the sub processing-winding unit supplied with the second separated yet-to-be-wound base paper.

2 Claims, 2 Drawing Sheets

(51) Int. Cl.
*B65H 20/02* (2006.01)
*D21H 27/30* (2006.01)

(58) Field of Classification Search
USPC ..... 270/52.1, 52.11; 242/530, 531, 531.1
See application file for complete search history.

(56) References Cited

U.S. PATENT DOCUMENTS

| | | | | |
|---|---|---|---|---|
| 3,953,638 | A * | 4/1976 | Kemp | A47K 10/16 428/154 |
| 4,690,347 | A * | 9/1987 | Grise | B65H 39/16 156/514 |
| 5,312,059 | A * | 5/1994 | Membrino | B65H 18/08 242/525 |
| 5,967,447 | A * | 10/1999 | Hinz | B65H 18/103 242/530 |
| 6,315,023 | B1 * | 11/2001 | King | B32B 38/1841 156/387 |
| 10,029,436 | B2 * | 7/2018 | Hirasawa | D21H 27/005 |
| 2006/0278357 | A1 | 12/2006 | Suzuki et al. | |
| 2011/0214829 | A1 | 9/2011 | Loippo et al. | |
| 2012/0216973 | A1 | 8/2012 | Ales et al. | |
| 2017/0320690 | A1 * | 11/2017 | Cattacin | B65H 19/22 |

FOREIGN PATENT DOCUMENTS

| | | | |
|---|---|---|---|
| CN | 104420386 | A | 3/2015 |
| CN | 205973256 | U | 2/2017 |
| GB | 915371 | A | 1/1963 |
| GB | 950313 | A | 2/1964 |
| JP | 50-22929 | B | 8/1975 |
| JP | 2011-104184 | A | 6/2011 |
| JP | 2012-170659 | A | 9/2012 |

OTHER PUBLICATIONS

Office Action dated Dec. 25, 2020 from the China National Intellectual Property Administration in CN Application No. 201780088494.5.

Extended European Search Report dated Jan. 12, 2021 from the European Patent Office in EP Application No. 17929186.9.

* cited by examiner

LOG ROLL MANUFACTURING APPARATUS

CROSS REFERENCE TO RELATED APPLICATIONS

This application is a National Stage of International Application No. PCT/JP2017/037977 filed Oct. 20, 2017.

TECHNICAL FIELD

The present invention relates to a log roll manufacturing apparatus that manufactures a log roll by winding up long base paper, for toilet paper, kitchen roll paper or the like, by a predetermined length.

BACKGROUND ART

In the related art, one-ply products (i.e. so-called single rolls) and two-ply products (i.e. so-called double rolls) are commercially available as toilet paper obtained by winding water-soluble base paper into log rolls and cutting the log rolls into a desired width. Log rolls for single rolls and log rolls for double rolls can be manufactured by adaptively using the same winder (i.e. log roll manufacturing apparatus). The same applies to manufacturing of log rolls for, for example, kitchen roll paper.

For example, in a case where a one-ply log roll is to be manufactured for toilet paper, long single-layer base paper delivered from a single parent roll, around which the base paper for toilet paper is wound to a large diameter, undergoes, for example, embossing and perforation-forming processes. Subsequently, the base paper is wound around the outer peripheral surface of a long core tube by a product length (e.g. 60 m), and the terminal end of the base paper is fixed by bonding (e.g. see first embodiment in PTL 1). In a case where a two-ply log roll is to be manufactured, long double-layer base paper constituted of stacked sheets of long single-layer base paper delivered from two parent rolls, around which the sheets of base paper for toilet paper are wound to a large diameter, undergoes, for example, embossing and perforation-forming processes. Subsequently, the base paper is wound around the outer peripheral surface of a long core tube by a product length (e.g. 30 m), and the terminal end of the base paper is fixed by bonding (e.g. see second embodiment in PTL 1).

CITATION LIST

Patent Literature

[PTL 1]: Japanese Unexamined Patent Application Publication No. 2011-104184

SUMMARY OF INVENTION

Technical Problem

However, in a case where a one-ply log roll is to be manufactured by using the toilet-paper manufacturing winder described in PTL 1, since the product length by which the base paper has to be wound is twice as that of a two-ply product, the product efficiency of a one-ply product is lower than that of a two-ply product. In addition, regardless of the fact that the toilet-paper manufacturing winder described in PTL 1 is preliminarily equipped with two base-paper feeders that can be used to feed sheets of base paper simultaneously from two parent rolls, only one base-paper feeder is used when a one-ply log roll is to be manufactured. This is inefficient since the remaining base-paper feeder cannot be used effectively.

An object of the present invention is to efficiently manufacture a log roll in a log roll manufacturing apparatus capable of manufacturing a multi-ply log roll by using a plurality of parent rolls.

Solution to Problem

In order to solve the aforementioned problem, the invention according to Apparatus 1 provides a log roll manufacturing apparatus including a yet-to-be-wound base-paper delivery unit and a processing-winding unit. The yet-to-be-wound base-paper delivery unit delivers multiple-layer base paper as yet-to-be-wound base paper. The multiple-layer base paper is fed from a plurality of parent rolls and constituted of stacked sheets of base paper fed from the plurality of parent rolls. The processing-winding unit performs a predetermined process on the yet-to-be-wound base paper delivered from the yet-to-be-wound base-paper delivery unit and winds up the yet-to-be-wound base paper by a predetermined length so as to form a one-ply or multi-ply log roll. The processing-winding unit includes one or more sub processing-winding units in addition to a main processing-winding unit to be preferentially used during a log roll manufacturing process. A base-paper separating unit and a base-paper guide unit are provided between the yet-to-be-wound base-paper delivery unit and the processing-winding unit. The base-paper separating unit separates the yet-to-be-wound base paper constituted of multiple layers of base paper into sheets of single-layer and/or multiple-layer separated yet-to-be-wound base paper. The base-paper guide unit guides the sheets of single-layer or multiple-layer separated yet-to-be-wound base paper separated at the base-paper separating unit separately toward the main processing-winding unit and the one or more sub processing-winding units.

According to the invention according Apparatus 2, in the log-roll manufacturing apparatus according to Apparatus 1, the base-paper separating unit is provided with delamination facilitating means for facilitating delamination of the yet-to-be-wound base paper constituted of multiple layers of base paper.

According to the invention according to Apparatus 3, in the log roll manufacturing apparatus according to Apparatus 1 or 2, the number of parent rolls that can be handled by the yet-to-be-wound base-paper delivery unit and the number of processing-winding units installed are equal to each other. Multiple-layer yet-to-be-wound base paper constituted of stacked sheets of base paper fed from all of the parent rolls is entirely separated into sheets of single-layer separated yet-to-be-wound base paper by the base-paper separating unit, and the sheets of single-layer separated yet-to-be-wound base paper are guided by the base-paper guide unit to the main processing-winding unit and all of the sub processing-winding units, so that one-ply log rolls are simultaneously manufactured using all of the main processing-winding unit and the sub processing-winding units.

According to the invention according to Apparatus claim 4, in the log roll manufacturing apparatus according to Apparatus 1 or 2, the number of parent rolls that can be handled by the yet-to-be-wound base-paper delivery unit is larger than the number of processing-winding units installed. Multiple-layer yet-to-be-wound base paper constituted of stacked sheets of base paper fed from all of the parent rolls is separated by the base-paper separating unit such as to include multiple-layer separated yet-to-be-wound base paper. At least the multiple-layer separated yet-to-be-wound base paper is guided to the main processing-winding unit by the base-paper guide unit, and remaining separated yet-to-be-wound base paper separated into a single-layer and/or multiple layers is guided to any of the sub processing-winding units, so that the log roll manufacturing apparatus simultaneously manufactures a multi-ply log roll at the main processing-winding unit and a one-ply log roll and/or a multi-ply log roll at the remaining sub processing-winding unit.

Advantageous Effects of Invention

The log roll manufacturing apparatus according to the present invention includes the one or more sub processing-winding units in addition to the main processing-winding unit to be preferentially used during the log roll manufacturing process, and is also provided with the base-paper separating unit and the base-paper guide unit between the yet-to-be-wound base-paper delivery unit and the processing-winding unit. Therefore, if a one-ply or multi-ply log roll is to be manufactured by using the main processing-winding unit without fully using the parent rolls, a one-ply or multi-ply log roll can be manufactured at the sub processing-winding unit by using the surplus parent roll, thereby suppressing a decrease in the product efficiency of the log roll manufacturing apparatus.

DESCRIPTION OF EMBODIMENTS

Embodiments of a log roll manufacturing apparatus according to the present invention will be described in detail below with reference to the appended drawings.

Figure 1:
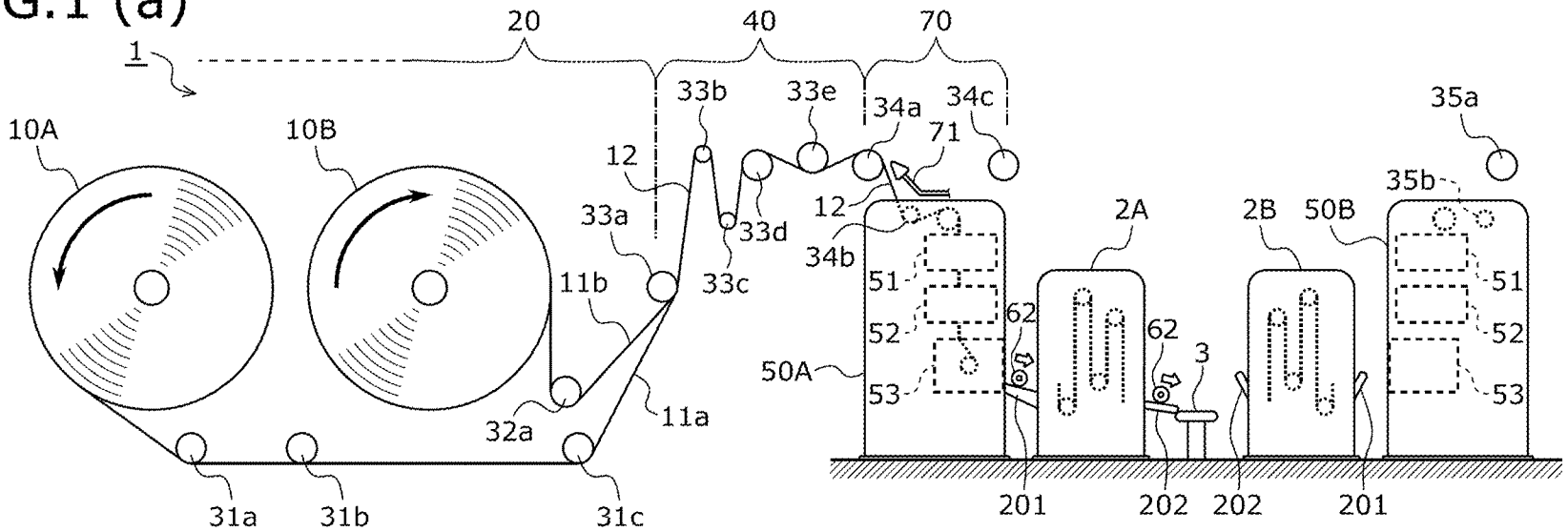
FIG. 1(*a*) and FIG. 1(*b*) illustrate a first embodiment of a log roll manufacturing apparatus according to the present invention, FIG. 1(*a*) being a schematic configuration diagram illustrating a case where a two-ply log roll is being manufactured, and FIG. 1(*b*) being a schematic configuration diagram illustrating a case where one-ply log rolls are being simultaneously manufactured at a main processing-winding unit and a sub processing-winding unit.
Figure 1:
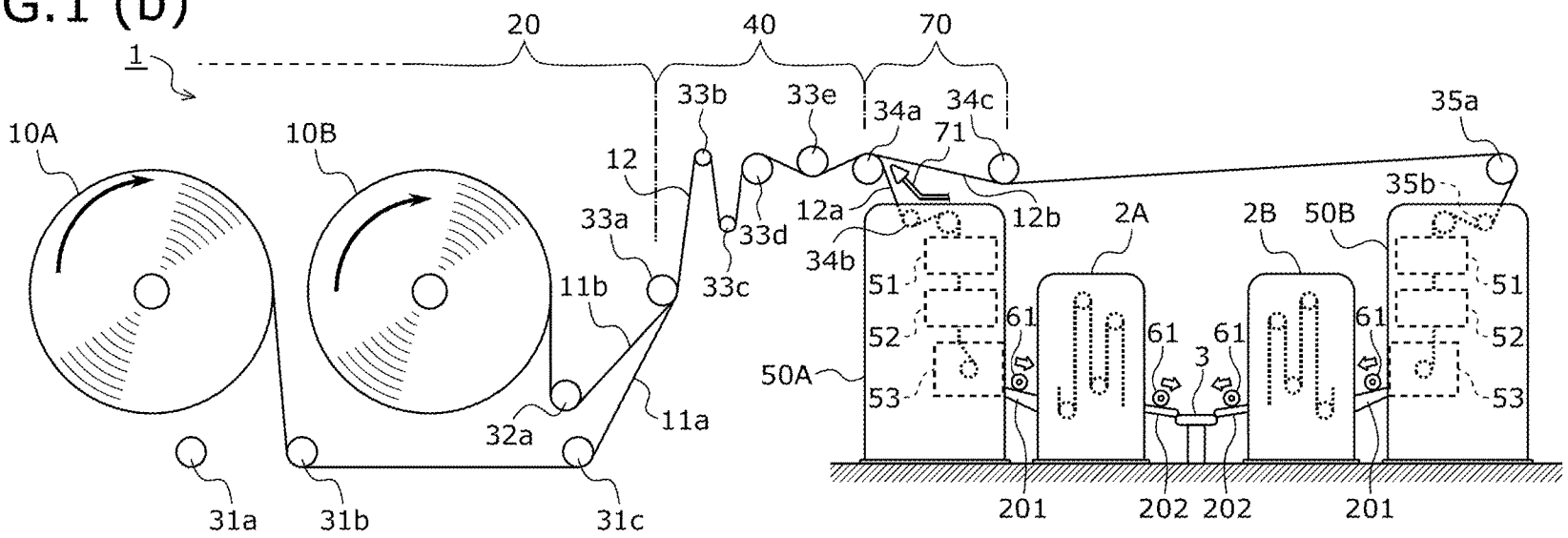

FIG. 1(*a*) and FIG. 1(*b*) illustrate a winder 1 according to a first embodiment of the log roll manufacturing apparatus. The winder 1 includes, for example, a base-paper feed unit 20 that feeds base paper from each of a first large-diameter parent roll 10A and a second large-diameter parent roll 10B. By using parent rolls having water-soluble base paper wound therearound, a log roll for toilet paper can be manufactured. By using parent rolls having high-water-absorbable base paper wound therearound, a log roll for kitchen roll paper can be manufactured. Because the base-paper feed unit 20 in the winder 1 according to this embodiment is capable of handling two parent rolls, namely, the first and second parent rolls 10A and 10B, a two-ply log roll can be manufactured. By configuring the base-paper feed unit 20 to handle three or more parent rolls, a log roll with three or more plies can also be manufactured.

The first parent roll 10A can be rotated at a freely-chosen speed in a freely-chosen direction by being set in a base-paper feeder (not illustrated). First base paper 11*a* fed from the first parent roll 10A is guided to, for example, a yet-to-be-wound base-paper delivery unit 40 via guide rollers 31*a*, 31*b*, and 31*c*. Likewise, the second parent roll 10B can be rotated at a freely-chosen speed in a freely-chosen direction by being set in a base-paper feeder (not illustrated). Second base paper 11*b* fed from the second parent roll 10B is guided to, for example, the yet-to-be-wound base-paper delivery unit 40 via a guide roller 32*a*. In this case, the rotation speeds of the base-paper feeders for the first and second parent rolls 10A and 10B are controlled such that the feed rate of the first base paper 11*a* and the feed rate of the second base paper 11*b* substantially match.

The first base paper 11*a* and the second base paper 11*b* fed from the base-paper feed unit 20 in the above-described manner are stacked via a guide roller 33*a* of the yet-to-be-wound base-paper delivery unit 40 so as to become a double-layer yet-to-be-wound base paper 12. For example, the yet-to-be-wound base paper 12 is delivered via guide rollers 33*b*, 33*c*, 33*d*, and 33*e* so as to be supplied to a main processing-winding unit 50A. In this case, it is desirable that the first base paper 11*a* and the second base paper 11*b* be stacked such that the top surface of the first base paper 11*a* (i.e. the surface appearing on the outer side of the first parent roll 10A) and the top surface of the second base paper 11*b* (i.e. the surface appearing on the outer side of the second parent roll 10B) are two outer surfaces, respectively, of the yet-to-be-wound base paper 12.

The main processing-winding unit 50A includes, for example, embossing means 51 and perforation-forming means 52 and is capable of performing an embossing process and a perforation-forming process on the yet-to-be-wound base paper 12. Subsequently, at winding means 53, the yet-to-be-wound base paper 12 is wound around the outer peripheral surface of a long core tube by a product length (e.g. 30 m), and the terminal end of the yet-to-be-wound base paper 12 is fixed by bonding, so that a two-ply log roll 62 is formed. The processing functions provided in the main processing-winding unit 50A are not particularly limited. The main processing-winding unit 50A may further be provided with a function for adding a deodorant or fragrance, or may be configured not to perform any of these processing functions. Furthermore, the winding means 53 may alternatively be configured to form a coreless log roll.

A main accumulator 2A is provided in correspondence with the main processing-winding unit 50A of the winder 1 that manufactures a log roll in the above-described manner. The log roll (e.g. the two-ply log roll 62) output from the main processing-winding unit 50A is received by a reception arm 201 of the main accumulator 2A and is retained therein. The log roll is then supplied to a conveyance path 3 from a supply arm 202 at an appropriate timing. The log roll supplied to the conveyance path 3 is cut to a product width by a log cutter (not illustrated), and a predetermined number of log rolls are packaged.

The winder 1 according to this embodiment includes a sub processing-winding unit 50B in addition to the main processing-winding unit 50A. The sub processing-winding unit 50B similarly includes embossing means 51, perforation-forming means 52, and winding means 53, and has a function of manufacturing a two-ply log roll 62 by receiving yet-to-be-wound base paper 12. A sub accumulator 2B is provided in correspondence with the sub processing-winding unit 50B. A log roll output from the sub processing-winding unit 50B is received by a reception arm 201 of the sub accumulator 2B and is retained therein. The log roll is then supplied to the conveyance path 3 from a supply arm 202 at an appropriate timing.

Accordingly, the main processing-winding unit 50A and the sub processing-winding unit 50B have identical functions so that one can substitute for the other. However, for the sake of convenience, the aforementioned main processing-winding unit 50A is preferentially used when a log roll is to be manufactured. As illustrated in FIG. 1(*a*), when the two-ply log roll 62 is to be manufactured by stacking the first base paper 11*a* and the second base paper 11*b* fed from the first and second parent rolls 10A and 10B, the main processing-winding unit 50A alone is used, whereas the sub processing-winding unit 50B is not used. In the following description, the main processing-winding unit 50A and the sub processing-winding unit 50B may simply be referred to as a processing-winding unit 50 if the two are not to be distinguished from each other.

Furthermore, the winder 1 according to this embodiment is provided with a base-paper separating unit 70 between the yet-to-be-wound base-paper delivery unit 40 and the processing-winding unit 50. The base-paper separating unit 70 is capable of separating the double-layer yet-to-be-wound base paper 12, which is constituted of the first base paper 11*a* and the second base paper 11*b*, into first separated yet-to-be-wound base paper 12*a* and second separated yet-to-be-wound base paper 12*b*, both having a single layer. In detail, the lower-layer sheet (i.e. first base paper 11*a*) of the yet-to-be-wound base paper 12 introduced to an inlet guide roller 34*a* is set on a first separating guide roller 34*b*, and the upper-layer sheet (i.e. second base paper 11*b*) of the yet-to-be-wound base paper 12 is set on a second separating guide roller 34*c*, so that the yet-to-be-wound base paper 12 can be separated into the first separated yet-to-be-wound base paper 12*a* to be guided toward the first separating guide roller 34*b* and the second separated yet-to-be-wound base paper 12*b* to be guided toward the second separating guide roller 34*c*.

As described above, by varying the direction in which the first separated yet-to-be-wound base paper 12*a* is guided by the first separating guide roller 34*b* and the direction in which the second separated yet-to-be-wound base paper 12*b* is guided by the second separating guide roller 34*c* with respect to the inlet guide roller 34*a*, and then pulling the first separated yet-to-be-wound base paper 12*a* and the second separated yet-to-be-wound base paper 12*b* in the respective guiding directions at the same speed, the double-layer yet-to-be-wound base paper 12 is inevitably separated into sheets of single-layer paper. However, if the yet-to-be-wound base paper 12, which is long, is separated unevenly in the width direction thereof, problems, such as irregular winding and twisting, may possibly occur. Hence, the base-paper separating unit 70 is provided with delamination facilitating means 71 for facilitating delamination of the yet-to-be-wound base paper 12.

For example, a delamination blade that is wedge-shaped in cross section may be provided as the delamination facilitating means 71 near the inlet guide roller 34*a*, so that the stacked layers of the yet-to-be-wound base paper 12 are pressed against the delamination blade and are delaminated into the upper layer and the lower layer, whereby the yet-to-be-wound base paper 12 can be separated into the first separated yet-to-be-wound base paper 12*a* and the second separated yet-to-be-wound base paper 12*b*. However, the delamination blade directly coming into contact with the yet-to-be-wound base paper 12 may possibly roughen the paper surface and impair the texture thereof. Hence, as another configuration example of the delamination facilitating means 71, for example, a plurality of air nozzles may be disposed at predetermined intervals in the width direction of the yet-to-be-wound base paper 12, and air with predetermined pressure may be sent to the air nozzles from an air duct, so that the air can be discharged toward the stacked layers of the yet-to-be-wound base paper 12. Accordingly, wind pressure from the air nozzles is applied to the stacked layers of the yet-to-be-wound base paper 12. This facilitates the delamination of the yet-to-be-wound base paper 12 into the upper layer and the lower layer and can separate the yet-to-be-wound base paper 12 into the first separated yet-to-be-wound base paper 12*a* and the second separated yet-to-be-wound base paper 12*b* without roughening the paper surface. In addition, this is also advantageous in that fiber pieces peeling off from the yet-to-be-wound base paper 12 when separated into the first separated yet-to-be-wound base paper 12*a* and the second separated yet-to-be-wound base paper 12*b* can be removed by being blown by the wind pressure from the air nozzles.

The first separated yet-to-be-wound base paper 12*a* separated from the yet-to-be-wound base paper 12 at the base-paper separating unit 70 is guided to the main processing-winding unit 50A. Because the base-paper separating unit 70 is disposed near the main processing-winding unit 50A, the first separated yet-to-be-wound base paper 12*a* is introduced to the main processing-winding unit 50A by being guided from the inlet guide roller 34*a* to the first separating guide roller 34*b*. Thus, a first base-paper guide unit that guides the first separated yet-to-be-wound base paper 12*a* separated at the base-paper separating unit 70 toward the main processing-winding unit 50A does not have to be additionally provided.

On the other hand, the second separated yet-to-be-wound base paper 12*b* separated from the yet-to-be-wound base paper 12 at the base-paper separating unit 70 is guided to the sub processing-winding unit 50B from the second separating guide roller 34*c* via guide rollers 35*a* and 35*b*. Specifically, the guide rollers 35*a* and 35*b* function as a second base-paper guide unit that guides the second separated yet-to-be-wound base paper 12*b* separated at the base-paper separating unit 70 toward the sub processing-winding unit 50B.

In the winder 1 having the above-described configuration, a one-ply log roll 61 can be manufactured by simply introducing the first base paper 11*a* fed from the first parent roll 10A to the main processing-winding unit 50A, but one-ply log rolls 61 can be manufactured more efficiently by simultaneously using the second base paper 11*b* fed from the second parent roll 10B and the sub processing-winding unit 50B.

Specifically, as illustrated in FIG. 1(*b*), yet-to-be-wound base paper 12 obtained by stacking the first base paper 11*a* and the second base paper 11*b*, fed from the first and second parent rolls 10A and 10B, at the yet-to-be-wound base-paper delivery unit 40 is separated into the first separated yet-to-be-wound base paper 12*a* and the second separated yet-to-be-wound base paper 12*b*, both having a single layer, at the base-paper separating unit 70. The first separated yet-to-be-wound base paper 12*a* is introduced to the main processing-winding unit 50A via a first base-paper guide unit so that a one-ply log roll 61 is manufactured, and at the same time, the second separated yet-to-be-wound base paper 12*b* is introduced to the sub processing-winding unit 50B via the second base-paper guide unit so that a one-ply log roll 61 is manufactured.

Accordingly, the winder 1 according to this embodiment can simultaneously manufacture a one-ply log roll at the main processing-winding unit 50A and a one-ply log roll at the sub processing-winding unit 50B, so that the efficiency for manufacturing log rolls can be doubled. In addition, even when the main processing-winding unit 50A cannot be used due to a failure or maintenance, a one-ply or two-ply log roll can still be manufactured by the sub processing-winding unit 50B so long as the sub processing-winding unit 50B is operable, thereby eliminating the need to stop the winder 1 when the main processing-winding unit 50A is not usable. Specifically, by using the sub processing-winding unit 50B as a backup function for the main processing-winding unit 50A, the operation rate of the winder 1 is not decreased, thereby contributing to increased efficiency for manufacturing log rolls.

The main processing-winding unit 50A and the sub processing-winding unit 50B do not necessarily have to have identical functions. A processing-winding unit with a processing function and a winding function inferior to those of the main processing-winding unit 50A serving as a main unit may be used as the sub processing-winding unit 50B. Furthermore, since the number of log rolls that are to accumulate in the main accumulator 2A and the number of log rolls that are to accumulate in the sub accumulator 2B are equal to each other so long as the rate at which log rolls are manufactured at the main processing-winding unit 50A and the rate at which log rolls are manufactured at the sub processing-winding unit 50B are the same, log rolls may be supplied to the conveyance path 3 alternately from the main accumulator 2A and the sub accumulator 2B, so that an adjustment can be made to prevent an imbalance between the number of log rolls retained in the main accumulator 2A and the number of log rolls retained in the sub accumulator 2B. In contrast, if the rate at which log rolls are manufactured at the main processing-winding unit 50A and the rate at which log rolls are manufactured at the sub processing-winding unit 50B are different, log rolls may be supplied to the conveyance path 3 preferentially from the accumulator 2 that corresponds to the processing-winding unit 50 with the higher log-roll manufacturing rate.

In a case of a log roll manufacturing apparatus that can manufacture a three-ply log roll, the log roll manufacturing apparatus is capable of handling three parent rolls. Thus, a first sub processing-winding unit and a second sub processing-winding unit are provided in addition to the main processing-winding unit. The yet-to-be-wound base paper is separated into first separated yet-to-be-wound base paper, second separated yet-to-be-wound base paper, and third separated yet-to-be-wound base paper at the base-paper separating unit. The first separated yet-to-be-wound base paper is introduced to the main processing-winding unit via a first base-paper guide path, the second separated yet-to-be-wound base paper is introduced to the first sub processing-winding unit via a second base-paper guide path, and the third separated yet-to-be-wound base paper is introduced to the second sub processing-winding unit via a third base-paper guide path, so that three one-ply log rolls can be simultaneously manufactured by the main processing-winding unit and the first and second sub processing-winding units. Specifically, by configuring the log roll manufacturing apparatus such that the number of parent rolls is equal to the number of processing-winding units installed, one-ply log rolls equal in number to the number of parent rolls can be simultaneously manufactured, so that the manufacturing efficiency can be dramatically increased.

Figure 2:
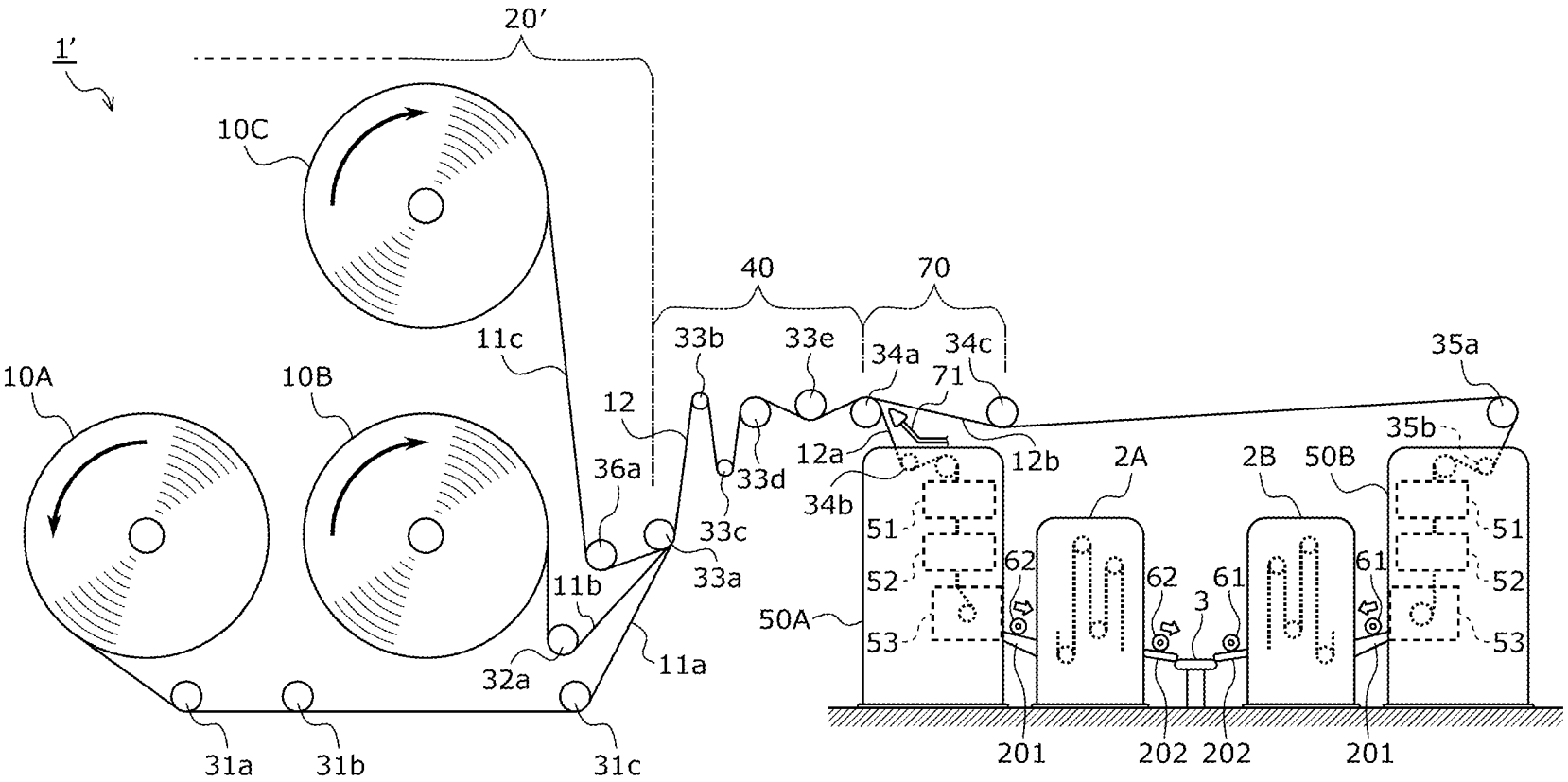
FIG. 2 illustrates a second embodiment of the log roll manufacturing apparatus according to the present invention and is a schematic configuration diagram illustrating a case where a two-ply log roll and a one-ply log roll are simultaneously manufactured at the main processing-winding unit and the sub processing-winding unit, respectively.

However, if the number of sub processing-winding units installed is to be increased in accordance with the number of parent rolls that can be handled, a wide-area production line has to be prepared accordingly, and there are inevitably limitations in view of the size of the factory. Hence, FIG. 2 illustrates a winder 1' as a second embodiment of the log roll manufacturing apparatus that can efficiently manufacture log rolls even when the number of parent rolls is larger than the number of processing-winding units installed. Functions identical to those of the winder 1 in FIG. 1 are given the same reference signs, and descriptions thereof will be omitted.

The winder 1' includes a base-paper feed unit 20' that feeds third base paper 11*c* via a guide roller 36*a* from a third parent roll 10C, provided in addition to the first and second parent rolls 10A and 10B. The first base paper 11*a* to the third base paper 11*c* fed from the first to third parent rolls 10A to 10C are stacked at the yet-to-be-wound base-paper delivery unit 40, and are directly supplied as triple-layer yet-to-be-wound base paper 12 to the main processing-winding unit 50A, so that a three-ply log roll is manufactured at the main processing-winding unit 50A. In this case, since the first to third parent rolls 10A to 10C are fully utilized, the sub processing-winding unit 50B is not used.

However, if a two-ply log roll is to be formed at the main processing-winding unit 50A, double-layer yet-to-be-wound base paper 12 constituted of stacked sheets of the first base paper 11*a* and the second base paper 11*b* fed from the first and second parent rolls 10A and 10B may simply be supplied to the main processing-winding unit 50A. In this case, however, the third parent roll 10C is vacant. Hence, the first base paper 11*a* to the third base paper 11*c* fed from the first to third parent rolls 10A to 10C are formed into triple-layer yet-to-be-wound base paper 12 at the yet-to-be-wound base-paper delivery unit 40, and the triple-layer yet-to-be-wound base paper 12 is separated into double-layer first separated yet-to-be-wound base paper 12*a* (i.e. yet-to-be-wound base paper constituted of stacked sheets of the first base paper 11*a* and the second base paper 11*b*) and single-layer second separated yet-to-be-wound base paper 12*b* (i.e. single-layer yet-to-be-wound base paper formed of the third base paper 11*c* alone) at the base-paper separating unit 70. The first separated yet-to-be-wound base paper 12*a* is supplied to the main processing-winding unit 50A so that a two-ply log roll 62 is manufactured, and at the same time, the second separated yet-to-be-wound base paper 12*b* is supplied to the sub processing-winding unit 50B so that a one-ply log roll 61 is manufactured.

If the number of parent rolls that can be handled (i.e. three parent rolls, namely, the first to third parent rolls 10A to 10C) is larger than the number of processing-winding units 50 installed (i.e. two processing-winding units, namely, the main processing-winding unit 50A and the sub processing-winding unit 50B), as in the winder 1', the triple-layer yet-to-be-wound base paper 12 constituted of stacked sheets of the first base paper 11*a* to the third base paper 11*c* fed from all of the first to third parent rolls 10A to 10C is separated at the base-paper separating unit 70 into double-layer first separated yet-to-be-wound base paper 12*a* and single-layer second separated yet-to-be-wound base paper 12*b*, such as to include multiple-layer separated yet-to-be-wound base paper. The first separated yet-to-be-wound base paper 12*a* is guided to the main processing-winding unit 50A by the first base-paper guide unit, and the remaining single-layer second separated yet-to-be-wound base paper 12*b* is guided to the sub processing-winding unit 50B by the second base-paper guide unit, so that a two-ply log roll 62 and a one-ply log roll 61 are simultaneously manufactured at the main processing-winding unit 50A and the sub processing-winding unit 50B, respectively. Consequently, all of the parent rolls and all of the processing-winding units are effectively used, so that the manufacturing efficiency can be increased.

Furthermore, in a case where a log roll manufacturing apparatus that can manufacture a four-ply log roll includes two processing-winding units, yet-to-be-wound base paper is separated into double-layer first separated yet-to-be-wound base paper and double-layer second separated yet-to-be-wound base paper at the base-paper separating unit, so that a two-ply log roll is manufactured at the main processing-winding unit and a two-ply log roll is manufactured at the sub processing-winding unit at the same time. Consequently, all of the parent rolls and all of the processing-winding units are effectively used, so that the manufacturing efficiency can be increased. Alternatively, in a case where a log roll manufacturing apparatus that can manufacture a four-ply log roll includes three processing-winding units, yet-to-be-wound base paper is separated into double-layer first separated yet-to-be-wound base paper, single-layer second separated yet-to-be-wound base paper, and single-layer third separated yet-to-be-wound base paper at the base-paper separating unit, so that a two-ply log roll is manufactured at the main processing-winding unit, a one-ply log roll is manufactured at the first sub processing-winding unit, and a one-ply log roll is manufactured at the second sub processing-winding unit at the same time. Consequently, all of the parent rolls and all of the processing-winding units are effectively used, so that the manufacturing efficiency can be increased.

Even in a log roll manufacturing apparatus in which the number of parent rolls that can be handled is larger than the number of processing-winding units installed, as in the winder 1' according to the second embodiment, allocation may be performed such that all of the parent rolls and all of the processing-winding units are effectively used to simultaneously manufacture one-ply or multi-ply log rolls, thereby preventing a parent roll or a processing-winding unit from being wastefully left in an unused state. Consequently, the efficiency for manufacturing log rolls can be increased.

Although several embodiments with respect to the log roll manufacturing apparatus according to the present invention have been described above with reference to the appended drawings, the present invention is not limited to these embodiments and may be implemented by using a known equivalent technology within a scope that does not alter the configuration defined in the claims.

REFERENCE SIGNS LIST

1 log roll manufacturing apparatus (first embodiment)
10A first parent roll
10B second parent roll
11*a* first base paper
11*b* second base paper
12 yet-to-be-wound base paper
12*a* first separated yet-to-be-wound base paper
12*b* second separated yet-to-be-wound base paper
40 yet-to-be-wound base-paper delivery unit
50A main processing-winding unit
50B sub processing-winding unit
61 one-ply log roll
62 two-ply log roll
70 base-paper separating unit

The invention claimed is:

1. A log roll manufacturing apparatus comprising:

a yet-to-be-wound base-paper delivery unit that delivers multiple-layer base paper as yet-to-be-wound base paper, the multiple-layer base paper being fed from a plurality of parent roll and being constituted of stacked sheets of base paper fed from the plurality of parent rolls; and a processing-winding unit that performs a predetermined process on the yet-to-be-wound base paper delivered from the yet-to-be-wound base-paper delivery unit and that winds up the yet-to-be-wound base paper by a predetermined length so as to form a one-ply or multi-ply log roll, wherein the processing-winding unit includes one or more sub processing-winding units in addition to a main processing-winding unit to be used during a log roll manufacturing process, wherein a base-paper separating unit and a base-paper guide unit are provided between the yet-to-be-wound base-paper delivery unit and the processing-winding unit, the base-paper separating unit separating the yet-to-be-wound base paper constituted of multiple layers of base paper into sheets of single-layer and/or multiple-layer separated yet-to-be-wound base paper, the base-paper guide unit guiding the sheets of single-layer or multiple-layer separated yet-to-be-wound base paper separated at the base-paper separating unit separately toward the main processing-winding unit and the one or more sub processing-winding units, wherein the number of parent rolls that can be handled by the yet-to-be-wound base-paper delivery unit is larger than the number of processing-winding units installed, and wherein multiple-layer yet-to-be-wound base paper constituted of stacked sheets of base paper fed from all of the parent rolls is separated by the base-paper separating unit such as to include multiple-layer separated yet-to-be-wound base paper, wherein at least the multiple-layer separated yet-to-be-wound base paper is guided to the main processing-winding unit by the base-paper guide unit, and wherein remaining separated yet-to-be-wound base paper separated into a single-layer and/or multiple layers is guided to any of the sub processing-winding units, so that the log roll manufacturing apparatus simultaneously manufactures a multi-ply log roll at the main processing-winding unit and a one-ply log roll and/or a multi-ply log roll at the remaining sub processing-winding unit.

2. The log roll manufacturing apparatus according to claim 1, wherein the base-paper separating unit is provided with delamination facilitating means for facilitating delamination of the yet-to-be-wound base paper constituted of multiple layers of base paper.

* * * * *